US005243508A

United States Patent [19]

Ewing et al.

[11] Patent Number: 5,243,508

[45] Date of Patent: Sep. 7, 1993

[54] MODULAR LUMINAIRE ASSEMBLY

[75] Inventors: Robert L. Ewing, Newark; Richard A. Peterson, Columbus; Robert A. Catone, Granville, all of Ohio

[73] Assignee: Holophane Company, Inc., Newark, Ohio

[21] Appl. No.: 954,326

[22] Filed: Sep. 30, 1992

[51] Int. Cl.[5] ..... F21S 1/10

[52] U.S. Cl. ..... 362/431; 362/802

[58] Field of Search ..... 362/431, 226, 802

[56] References Cited

U.S. PATENT DOCUMENTS 3,071,683 1/1963 Queale ..... 240/25
3,297,864 1/1967 Waldbauer ..... 240/25
4,937,718 6/1990 Murray ..... 362/431
5,136,493 8/1992 Straus et al. ..... 362/431

*Primary Examiner*—Carroll B. Dority
*Attorney, Agent, or Firm*—Brooks & Kushman

[57] ABSTRACT

A modular luminaire assembly for receiving assorted optical assemblies and assorted electrical assemblies. The modular luminaire assembly includes a base unit having an opening on one side and a platform for receiving and supporting a selected optical assembly, and a removable panel assembly mountable within the base opening. The panel assembly is adapted to receive and support a selected electrical assembly. The base unit, optical assembly, and panel assembly form respective first, second and third unitary modules.

13 Claims, 2 Drawing Sheets

MODULAR LUMINAIRE ASSEMBLY

TECHNICAL FIELD

This invention relates generally to an ornamental modular street or walkway luminaire assembly, and more particularly to a mechanical design which provides for the interchange of different optical assemblies and different electrical assemblies as modular units affixable to a modular base unit.

BACKGROUND ART

Luminaire assembly designs of the prior art include a housing for enclosing and protecting electrical components required for operation of the luminaire, and an optical assembly. The optical assembly is generally comprised of a lighting unit and a refractor for producing and directing light of various intensities. These prior art designs often utilize electrical assemblies that are wired directly to the lighting unit through the use of a plurality of wires, splicing means, and/or permanent connecting means.

Direct wired electrical assemblies of the type referenced above have heretofore been used to ensure proper electrical contact between system components. Those skilled in the art will recognize, however, that such prior art designs have resulted in increased installation and maintenance costs because of the minimal flexibility afforded by the mechanical design. For example, it is known by those skilled in the art that particular system components of the luminaire assemblies of the type referenced herein often require repair, replacement and adjustment. In high pressure sodium systems, for example, starters, ballasts and capacitors are known to require routine maintenance. Similarly, the wattage and/or voltage characteristics of the employed lighting units often require adjustment to provide the proper amount of illumination and to conserve energy. These maintenance procedures often include the disassembly of sometimes heavy and awkward parts as well as the removal, splicing and reconnection of electrical wires. Because of the direct wired design of the prior art systems, these maintenance procedures must also be performed on-site or, in the alternative, the luminaire must be temporarily disabled while the particular component is repaired in the laboratory or factory.

The optical units of the prior art luminaire assemblies are also known to those skilled in the art to require routine repair, replacement and maintenance. For example, it is known that refractors and lighting units often must be replaced when the surfaces are penetrated by foreign substances or, when they have been fractured as a result of weather conditions or tampering. These time-consuming and labor intensive maintenance procedures must again be performed on-site and on a regular basis.

It is appreciated by those skilled in the art that the maintenance procedures referenced above are, of course, further hindered during adverse weather conditions, including heavy winds, rain and snow as well as extreme temperature gradients. The maintenance complications inherent in the prior art luminaire assembly designs have resulted in increased labor and maintenance costs which, in turn, have caused purchasers and luminaire designers to turn their attention toward viable design alternatives.

U.S. Pat. Nos. 3,297,864 and 3,071,683 issued to Waldbauer and Queale, respectively disclose prior art luminaire designs of the type referenced above. The Waldbauer patent for example, discloses a luminaire having a lighting unit, a refractor, and an electrical assembly mounted on a pivoting door. The system components of the Waldbauer luminaire are directly wired to the lighting unit.

Similarly, the Queale patent discloses a luminaire having a lighting unit, a refractor, and an electrical assembly wherein the luminaire is pivotably affixed to the luminaire housing at one end. Again, the electrical components are directly wired to the lighting unit and thus require maintenance on-site.

SUMMARY OF THE INVENTION

It is a general object of the present invention to provide a modular luminaire assembly wherein the system components may be readily repaired, replaced and adjusted on-site.

It is a further object of the present invention to provide a modular luminaire assembly having a common base unit capable of receiving a plurality of selected optical assemblies which may be readily exchanged to achieve different aesthetic appearances.

A more specific object of the present invention is the provision of a modular luminaire assembly including a unitary optical assembly, a unitary base and a unitary panel assembly including an electrical assembly, all of which are interchangeably connectable.

Another more specific object of the present invention is the provision of a modular luminaire assembly for receiving assorted optical assemblies and assorted electrical assemblies. In carrying out this object, the modular luminaire assembly of the present invention comprises a base unit having an opening on one side and a platform for receiving and supporting a selected optical assembly. A removable panel assembly is mounted within the base opening and is adapted to receive and support a selected electrical assembly. The base unit, selected optical assembly, and removable panel assembly all form respective first, second and third unitary modules.

The above objects and other objects, features and advantages of the present invention are readily apparent from the following detailed description of the best mode for carrying out the invention when taken in connection with the accompanying drawings.

BEST MODE FOR CARRYING OUT THE INVENTION

Figure 1:
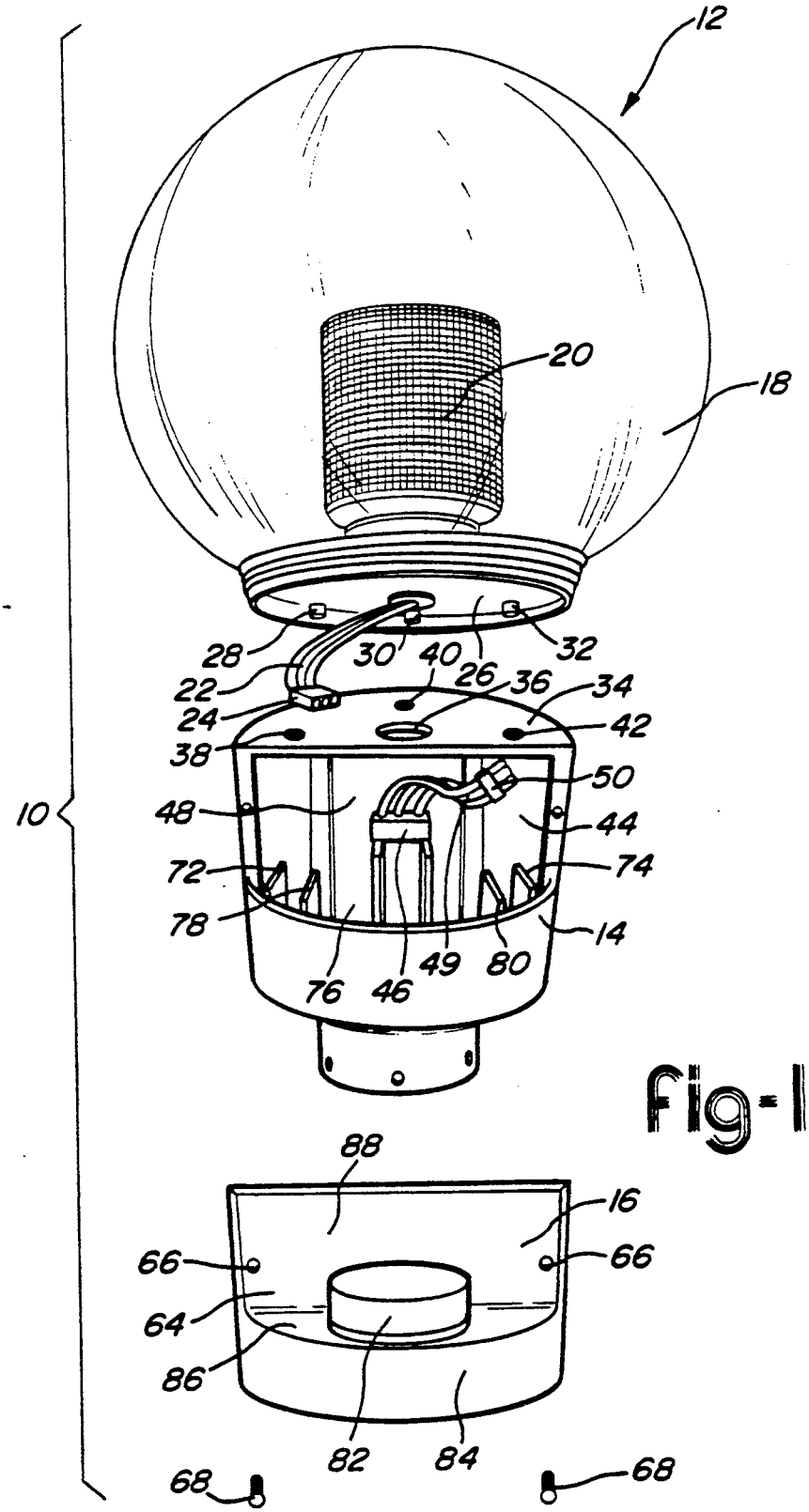
FIG. 1 is an exploded perspective view of a modular optical assembly, base unit, and removable panel assembly of the present invention.

With reference to FIG. 1, the modular luminaire assembly of the present invention is generally indicated by reference numeral 10. Modular luminaire assembly 10 is comprised of an optical assembly 12, a base unit 14 and a removable panel assembly 16. FIG. 1 shows one preferred embodiment of the present invention wherein a globe-shaped optical assembly is utilized. Optical assembly 12 includes refractor means 18, illumination means 20 and an illumination wiring group 22 in electrical contact with illumination means 20. An illumination quick disconnect 24 is electrically connected to illumination wiring group 22.

Optical assembly 12 further includes a first planar mating surface 26 affixable to base unit 14. Optical assembly 12 also includes three threaded fastening screws 28, 30 and 32 that extend below and away from first planar surface 26. Base unit 14 also includes a second planar surface 34 for receiving first planar surface 26. Second planar surface 34 includes a wire entry aperture 36 and three tapped apertures 38, 40 and 42 correspondingly located to receive fastening screws 28, 30 and 32.

Still referring to FIG. 1, optical assembly 12 is shown affixable to base unit 14 by fastening screws 28, 30 and 32 in cooperation with apertures 38, 40 and 42. It is recognized by applicants, however, that the optical assembly of the present invention may be affixed to the base unit 14 of the present invention by any suitable fastening means. Base unit 14 further includes an opening 44 for receiving removable panel assembly 16 and a terminal block 46.

Figure 2:
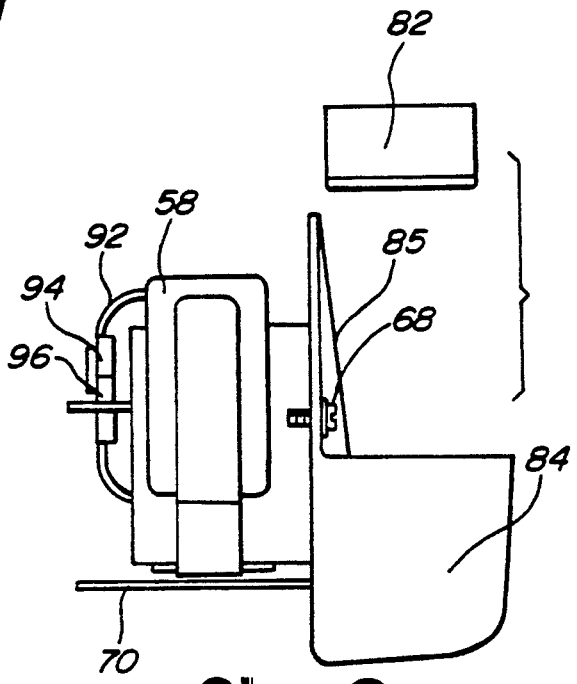
FIG. 2 is a side elevational view of the removable panel assembly of FIG. 1, shown including a twist lock photocontrol exploded away from the panel assembly.
Figure 3:
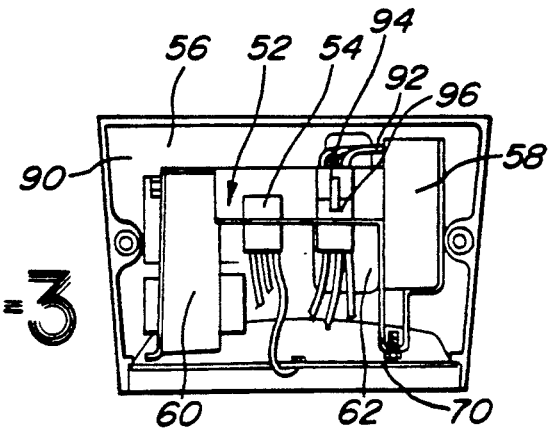
FIG. 3 is a rear elevational view of the removable panel assembly of FIGS. 1 and 2.

As shown in FIGS. 1–3, terminal block 46 is disposed on an inner side wall 48 of base unit 14 and includes a quick disconnect (not shown) for receiving illumination quick disconnect 24 which, in turn, extends from optical assembly 18. Terminal block 46 further includes a terminal block wiring group 49 having a terminal block quick disconnect 50 affixed at one end.

Referring now specifically to FIG. 3, there is shown an electrical assembly 52 having an electrical assembly quick disconnect 54 adapted to receive terminal block quick disconnect 50. Electrical assembly quick disconnect 54 is adapted to provide electrical contact between illumination means 20 and electrical assembly 52. As shown in FIG. 3, electrical assembly 52 is further adapted to fit adjacent the inner cavity 56 of removable panel assembly 16. Electrical assembly 52 may include a starter 58, which is used, for example, in high pressure sodium systems, a ballast 60 and a capacitor 62. These various electrical components are electrically connected pursuant to circuit configurations known to those skilled in the art to operate selected lighting units and optical assemblies.

Referring again to FIGS. 1 and 2, removable panel assembly 16 is shown received within opening 44 of base unit 14. Removable panel assembly 16 includes a door portion 64 having a pair of fastening holes 66 and fastening means 68 for securing removable panel assembly 16 to base unit 14. Removable panel assembly 16 further includes a mounting plate 70 for affixing selected electrical assemblies 52 to door portion 64. Attention is directed to elongated guide members 72 and 74 which extend longitudinally from inner base unit lower wall 76 to aid in receiving mounting plate 70. Slide tracks 78 and 80 also extend from inner lower wall 76 and are adapted to cooperate with base unit guide members 72 and 74 to properly position removable panel assembly 16 within opening 44.

The removable panel assembly 16 of FIG. 1 includes a twist lock photo control 82. The removable panel assembly 16 is also shown in more detail. For example, the front surface of panel assembly 16 is shown including an annular portion 84, a horizontal planar surface 86 and a tangential surface 88 extending up from horizontal surface 86. Electrical assembly 52 is also shown extending out and away from contact wall 90 of removable assembly panel 16. In accordance with the present invention, electrical assembly 52 is adapted to be positioned within opening 44 of base unit 14.

Still referring to FIG. 2, an electrical power source wiring group (not shown) extends the length of a stanchion (not shown) which supports the modular luminaire assembly. A power source (not shown), in cooperation with the power source wiring group, provides energization means for powering the electrical assembly. This electrical power source wiring group is permanently hard wired to terminal box 46. Electrical energy is thus transferred from the electrical power source wiring group to illumination means 20 via terminal block 46 and through electrical assembly 52.

As shown in FIG. 3, a starter 58 of the type commonly used in high pressure sodium systems, a ballast 60, a capacitor 62 and various electrical components comprise electrical assembly 52 of the present invention. The starter 58, ballast 60 and/or capacitor 62 are all disposed on a substantially planar mounting plate 70. A starter wiring group 92 is also provided in electrical contact with starter 58 through the use of a starter quick disconnect 94 which is adapted to receive a mated quick disconnect 96. In keeping with the invention, it is appreciated that starter 58 may be completely removed from mounting plate 70 and replaced on-site. Alternatively, panel assembly 16 may be replaced in full with the replacement assembly including a new starter. In either case, the repair or replacement may be achieved quickly, easily and without removal or splicing of any hard wired components.

In further keeping with the invention, attention is directed to optical assembly 12, removable panel assembly 14 and base unit 16 which have all been designed by applicants as interchangeable unitary modules. For example, removable panel assembly 16 can be replaced by yet another movable panel assembly which will, of course, include a completely assembled electrical assembly. The power and voltage characteristics of the electrical assembly can also be modified on-site without detaching any hard wiring. As referenced above, a service person may simply remove the panel assembly 16 and replace it with a new, repaired or different panel assembly on-site. In accordance with the invention, the operation of the luminaire need not be interrupted. Service and labor costs will also be drastically reduced.

Figure 4:
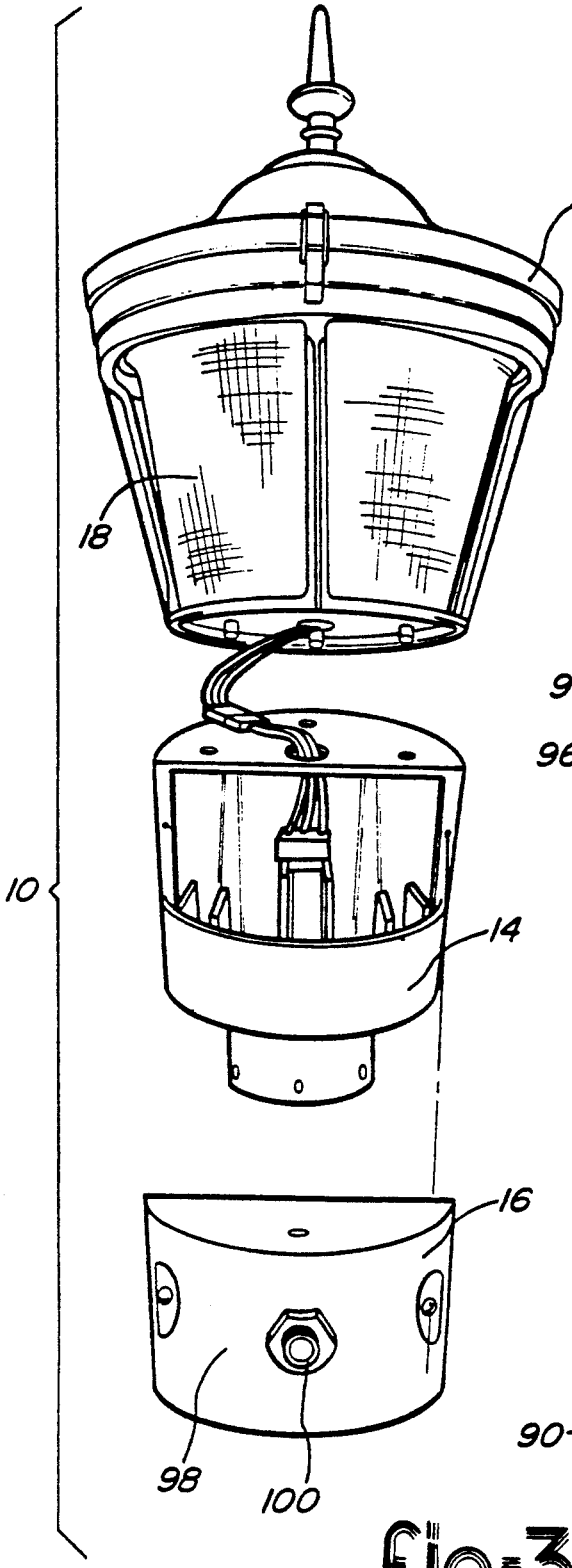
FIG. 4 is an exploded perspective view of an alternative embodiment of the modular luminaire assembly of the present invention, shown including an optical assembly, a base unit and removable panel assembly.

In accordance with the invention, approved electrical assemblies and optical assemblies may also be interchanged as may be required by the purchaser to achieve different illumination effects or aesthetic appearances. As shown in FIG. 1, for example, the luminaire assembly of the present invention is adapted to receive an optical assembly of the globe-type 18 as well as the colonial-type 102 as shown in FIG. 4. Again, it is appreciated that no hard wiring or splicing is necessary to effect such changes. In keeping with the invention, service personnel again may be dispatched on-site to quickly and easily remove and replace the optical and corresponding electrical assemblies. Whether design changes are driven by aesthetic, functional or repair considerations, it is appreciated that significant security, safety and energy savings may be realized as a result of the modular design of the present invention.

An additional embodiment of the present invention utilizes a wiring method wherein illumination wiring group 22 is wired directly into terminal block quick disconnect 50. When this method is utilized, removal of the optical unit requires loosening of terminal block wiring group 49 from terminal block 46. A mating electrical assembly quick disconnect 54 would still receive terminal block quick disconnect or two electrical assembly quick disconnects could be disposed on electrical assembly 52, one receiving terminal block wire group 49 and one receiving illumination wiring group 22.

FIG. 4 shows another alternative embodiment of the present invention wherein removable panel assembly 14 includes a door portion 98 configured to receive a button-type photo control 100. The door portion 98 of the alternate panel assembly is configured to follow the contour of base unit 14. As shown in FIG. 4, removable panel assembly 14 and optical assembly 12, when connected for operation of the luminaire, produce an aesthetically pleasing appearance that does not signify the advantageous modularity of the various interchangeable panel and optical assemblies.

As can be seen from the modularity of the optical assembly, base unit and removable panel assembly, the present invention overcomes significant replacement and maintenance problems associated with the prior art. For example, the removable panel assembly 16 of the present invention can be replaced by another removable panel assembly including a completely assembled electrical assembly. Modification of wattage or voltage of the present invention without any hard wiring or splicing can thus be accomplished. In practice, a service person may simply remove the panel assembly of the present invention, replace it with a new or different panel assembly and perform any necessary repair procedures off site. In this manner, the operation of the luminaire need not be interrupted. Service and labor costs may also be drastically reduced.

In addition, the modularity of the removable panel assembly allows for changes in combinations of electrical assemblies or optical assemblies including different illumination means requiring different wattage and voltages. Various aesthetic appearances can also be achieved quickly and easily by replacing the removable assembly or optical assembly. For example, the luminaire assembly of the present invention is adapted to receive an optical assembly of the globe-type 18 as shown in FIG. 1, as well as a colonial-type 102 as shown in FIG. 4. No hard wiring or splicing is necessary to effect such an exchange.

The luminaire assembly of the present invention further allows for easy modification from a twist lock photo control of the type indicated by reference numeral 82 to other sensing means such as a button type photo control with the replacement of a removal panel assembly. It should be appreciated that applicants' design obviates the need for rewiring or splicing of any electrical contact within the electrical assembly.

Referring still to FIG. 3, attention is further directed to starter 58 which is shown including a starter wiring group 92 and a starter quick disconnect 96. Starter quick disconnect 94 is adapted to electrically mate with a receiving quick disconnect 96. This design allows for a quick, complete replacement of the starter at the luminaire site. In operation, a new starter may be installed by detaching removable panel assembly 16 from base unit 14 and detaching quick disconnect 94 from receiving quick disconnect 96. The starter may therefore be easily removed from panel assembly 16. A new starter may then be attached to the panel assembly 16 and the starter quick disconnect 94 of the new starter may be positioned in electrical contact with receiving quick disconnect 96 of the electrical assembly.

It is appreciated that the modular design of the present invention results in reduced service and maintenance time because no hard wiring or splicing is required. For example, for starter replacement, service personnel will expend less time replacing failed starters utilizing the design of the present invention. Those skilled in the art will recognize and appreciate this reduction in service time is particularly important in high pressure sodium systems where starters are known to require routine maintenance even if operated under normal operating and weather conditions.

While the invention has been particularly shown and described in reference to the preferred embodiment thereof, it will be understood by those skilled in the art that various changes in form and details may be made therein without departing from the spirit and scope of the invention.

What is claimed is:

1. A modular luminaire assembly for operatively receiving assorted optical assemblies and assorted electrical assemblies, the luminaire assembly comprising:

a base unit having an opening on one side and a platform for receiving and supporting a selected optical assembly; and a removable panel assembly mountable within said base opening, the panel assembly adapted to receive and support a selected electrical assembly, wherein said base unit, said selected optical assembly and said removable panel assembly form respective, first, second and third unitary modules.

2. A modular luminaire assembly as in claim 1 wherein said platform is a planar surface having one wire entry aperture defined therein.

3. A modular luminaire assembly as in claim 1 wherein said removable panel assembly further comprises:

a door portion having fastening means for securing said removable panel assembly to said base unit; and a mounting plate for affixing said selected electrical assembly to said door portion.

4. A modular luminaire assembly as in claim 3 wherein said door portion further includes a receptacle for receiving a twist-lock photo control sensor, said sensor in electrical contact with said electrical assembly for controlling the operation of said luminaire.

5. A modular luminaire assembly as in claim 3 wherein said door portion further includes a receptacle for receiving a button-type photo control sensor, said sensor in electrical contact with said electrical assembly for controlling the operation of said luminaire.

6. A modular luminaire assembly as in claim 3 wherein said base unit includes an inner lower wall, said inner lower wall having affixed thereon a slide track member extending toward said platform for receiving and supporting said mounting plate.

7. A modular luminaire assembly as in claim 6 wherein said base unit further includes a pair of substantially parallel guide members affixed to said lower wall, said guide members extending toward said platform and adapted to cooperate with said slide track member and said mounting plate to properly position said removable panel assembly within said base opening.

8. A modular luminaire assembly as in claim 1 wherein said base unit further includes a mounting aperture for affixing said luminaire assembly to a support post.

9. A modular luminaire, comprising:

an optical assembly having illumination means for generating light, said optical assembly selected from a plurality of approved optical assemblies;

a base unit having an opening on one side and a platform for receiving and supporting said optical assembly;

an electrical assembly in electrical contact with said illumination means, said electrical assembly selected from a plurality of approved electrical assemblies;

energizing means for providing electrical energy to said electrical assembly, said energizing means in electrical contact with said electrical assembly;

a removable panel assembly mountable within said base opening, said panel assembly adapted to receive and support said selected electrical assembly, wherein said base unit, said removable panel assembly and said selected optical unit form respective first, second and third unitary modules.

10. A modular luminaire as in claim 9 wherein said base unit defines an enclosure having an inner lower wall and an inner side wall, said inner side wall having affixed thereon an electrical terminal block.

11. A modular luminaire as in claim 10 wherein said energizing means and illumination means are in electrical contact with said electrical terminal block and said illumination means is connectable to said electrical terminal block utilizing quick disconnect means to facilitate complete removal and replacement of said optical assembly without modification of said modular luminaire.

12. A modular luminaire as in claim 10 wherein said electrical assembly is in electrical contact with said electrical terminal block and is connectable to said electrical terminal block utilizing a quick disconnect means facilitating complete removal of said removable panel assembly supporting said electrical assembly and replacement of one of said plurality of electrical assemblies supported by a removable panel assembly without modification of said modular luminaire.

13. A modular luminaire as in claim 10 wherein said electrical assembly further includes a starter, said starter in electrical contact with a quick disconnect means, said quick disconnect means in electrical contact with said electrical terminal block, and said quick disconnect means adapted to allow complete removal of said starter.

* * * * *